US008331584B2

(12) United States Patent
Akino

(10) Patent No.: US 8,331,584 B2
(45) **Date of Patent: *Dec. 11, 2012**

(54) CAPACITOR MICROPHONE AND IMPEDANCE CONVERTER THEREFOR

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 278 days.

This patent is subject to a terminal disclaimer.

(21) Appl. No.: 12/765,023

(22) Filed: Apr. 22, 2010

(65) Prior Publication Data

US 2010/0272291 A1 Oct. 28, 2010

(30) Foreign Application Priority Data

Apr. 24, 2009 (JP) ..... 2009-106076

(51) Int. Cl.
*H04R 3/00* (2006.01)

(52) U.S. Cl. ..... 381/113; 381/319; 381/69.1

(58) Field of Classification Search ..... 381/111, 381/120, 174, 319, 112–116, 69.1; 357/61; 330/296

See application file for complete search history.

(56) References Cited

U.S. PATENT DOCUMENTS

| | | | | |
|---|---|---|---|---|
| 3,305,638 | A * | 2/1967 | Teachout | 381/111 |
| 3,449,523 | A * | 6/1969 | Kawakami et al. | 381/113 |
| 6,353,324 | B1 * | 3/2002 | Uber et al. | 324/457 |
| 6,453,048 | B1 | 9/2002 | Akino | |

* cited by examiner

*Primary Examiner* — Fan Tsang
*Assistant Examiner* — Eugene Zhao
(74) *Attorney, Agent, or Firm* — Whitham Curtis Christofferson & Cook, PC

(57) ABSTRACT

An impedance converter for a capacitor microphone includes: a vacuum tube that receives an output signal from a capacitor microphone unit through a grid and with which the signal is output as an output from a cathode follower; an FET in cascade connection with the vacuum tube and that defines a current flowing in the vacuum tube; and a bias circuit that applies a bias voltage to the grid of the vacuum tube. The bias circuit includes: a first diode and a second diode that apply the bias voltage to the grid of the vacuum tube; the first diode and the second diode being connected in inverse parallel; and a bias resistor for applying the bias voltage at a constant level to the grid of the vacuum tube via the first diode or the second diode.

5 Claims, 2 Drawing Sheets

CAPACITOR MICROPHONE AND IMPEDANCE CONVERTER THEREFOR

BACKGROUND OF THE INVENTION

1. Field of the Invention

The present invention relates to a capacitor microphone and an impedance converter therefor. More specifically, the present invention relates to a capacitor microphone and an impedance converter therefor using a vacuum tube as an impedance converting element improved for stable operation and avoidance of sound quality degradation.

2. Description of the Related Art

Capacitor microphones have small effective capacitance and high output impedance. Thus, for an output signal from a capacitor microphone, high input impedance is required to assure frequency response at a low frequency domain, as well as at a high frequency domain or a mid-frequency domain. Upon feeding an output signal from a capacitor microphone to an amplifier through a cable and the like, the output impedance of the capacitor microphone needs to be lowered. Therefore, capacitor microphones incorporate an impedance converter having high input impedance and low output impedance. A field-effect transistor (FET) is widely used as an impedance conversion element incorporated in a capacitor microphone.

A capacitor microphone is known that uses a vacuum tube as an impedance conversion element for obtaining higher sound quality and maximum output level (see, for example U.S. Pat. No. 6,453,048). U.S. Pat. No. 6,453,048 discloses, as an embodiment of the invention, an impedance converter including: a grounded plate amplifier tube; and a bias circuit that generates a bias voltage to be applied to the grid of the amplifier tube. The bias circuit includes: a first diode that applies a bias voltage to the grid of the amplifier tube so that a current flows to the grid; a second diode connected in inverse and parallel with the first diode; and a third diode provided between the cathode of the amplifier tube and a load resistance so that a current flows from the cathode of the amplifier tube to the load resistance. With a plate current flowing in the amplifier tube, a voltage generated in the third diode is applied to the grid of the amplifier tube as a bias voltage via the first or the second diodes.

By feeding a sound signal as a result of conversion by a capacitor microphone unit to the grid of the amplifier tube, an output signal from the capacitor microphone having high input impedance can be output as a low output impedance sound signal.

The impedance converter disclosed in U.S. Pat. No. 6,453,048 outputs a signal with a triode vacuum tube in cathode follower connection. A cathode follower realizes high input impedance and low output impedance. Thus, an increase in maximum output level can be achieved therewith.

As shown in FIG. 2, another embodiment of the invention disclosed in U.S. Pat. No. 6,453,048 includes: a first amplifier tube 2 which is the above-described amplifier tube in cathode follower connection; and a second amplifier tube 4 in cascade connection with the first amplifier tube 2. FIG. 2 shows a first diode 1A, a second diode 1B, a third diode 1E, a capacitor 1D, a capacitor microphone unit 100, an input terminal 4A, a ground side input terminal 4B, an input terminal 4C for a high voltage direct power supply, an output terminal 4D, and a ground terminal 4E. The second amplifier tube 4 is a triode. The cathode of the first amplifier tube 2 is connected to the plate of the second amplifier tube 4 via the third diode 1E in forward direction. A resistor 5 of a small resistance is connected between the high voltage power supply and the plate of the first amplifier tube 2. The plate of the first amplifier tube 2 is connected to the grid of the second amplifier tube 4 via a capacitor 6. A resistor 7 is connected between the ground and the cathode of the second amplifier tube 4. A circuit formed of the second amplifier tube 4 and the resistor 7 functions as a constant current load. The cathode of the second amplifier tube 4 is connected to the output terminal 40 so that an output signal is obtained from the cathode of the second amplifier tube 4. As described above, this embodiment of the impedance converter according to the invention disclosed in U.S. Pat. No. 6,453,048 aims to further lower the output impedance by cascade connection between the two amplifier tubes 2 and 4.

In the impedance converter according to the embodiment described in U.S. Pat. No. 6,453,048, the same amount of current, which is defined by the third diode 1E, flows in the first and the second amplifier tubes 2 and 4 due to the cascade connection. Unfortunately, the amplifier tubes 2 and 4 each formed of a vacuum tube have highly variable characteristics, and the potential of the output signal extracted from the output terminal 4D is difficult to be maintained at a constant level. Further, noise may be produced as a potential difference between the cathode and the heater of the first amplifier tube 2 becomes large to cause dielectric breakdown therebetween. A current flowing between the plate and the cathode of the first amplifier tube 2 is variable due to highly variable characteristics of the first and the second amplifier tubes 2 and 4 each formed of a triode. Accordingly, even if a constant bias voltage is applied to the amplifier tube 2 with the third diode 1E, the plate current and the output signal are variable.

Further, heater current needs to be supplied to both amplifier tubes 2 and 4. Thus, power consumption is high.

SUMMARY OF THE INVENTION

An object of the present invention is to solve the technical problems in U.S. Pat. No. 6,453,048. More specifically, an object of the present invention is to provide a capacitor microphone and an impedance converter therefor using a vacuum tube as an impedance converting element, with which plate current of the vacuum tube can be more stable, dielectric breakdown between the cathode and the heater of the vacuum tube and generation of noise following the dielectric breakdown can be prevented so that fine sound quality can be maintained, and power consumption can be reduced.

An impedance converter according to the present invention includes: a vacuum tube that receives an output signal from a capacitor microphone unit through a grid and with which the signal is output as an output from a cathode follower; an FET in cascade connection with the vacuum tube and that defines a current flowing in the vacuum tube; and a bias circuit that applies a bias voltage to the grid of the vacuum tube. The bias circuit includes: a first diode and a second diode that apply the bias voltage to the grid of the vacuum tube; the first diode and the second diode being connected in inverse parallel; and a bias resistor for applying the bias voltage at a constant level to the grid of the vacuum tube via the first diode or the second diode.

Preferably, a resistor for controlling a plate current of the vacuum tube is connected to the cascade connection of the vacuum tube and the FET.

A capacitor microphone according to the present invention includes the above described impedance converter.

EFFECT OF THE INVENTION

In the capacitor microphone and the impedance converter therefor, the vacuum tube as the impedance conversion element and the FET are in cascade connection. Thus, the FET can serve as a constant current diode and the plate current of the vacuum tube can be more stable.

Use of the FET instead of a vacuum tube as an element that defines a plate current of a vacuum tube used as an impedance conversion element can prevent dielectric breakdown as a result of a large potential difference between the cathode and the heater as in the case where another vacuum tube is used as the element that defines a plate current. Thus, noise due to the dielectric breakdown can be prevented. Further, because, instead of a vacuum tube, the FET is used as an element that defines a plate current of the vacuum tube used as an impedance conversion element, power consumption can be reduced as much as the power required for heating another vacuum tube.

DETAILED DESCRIPTION OF THE PREFERRED EMBODIMENTS

Embodiments of a capacitor microphone and an impedance converter therefor according to the present invention are described below with reference to a drawing.

Figure 1:
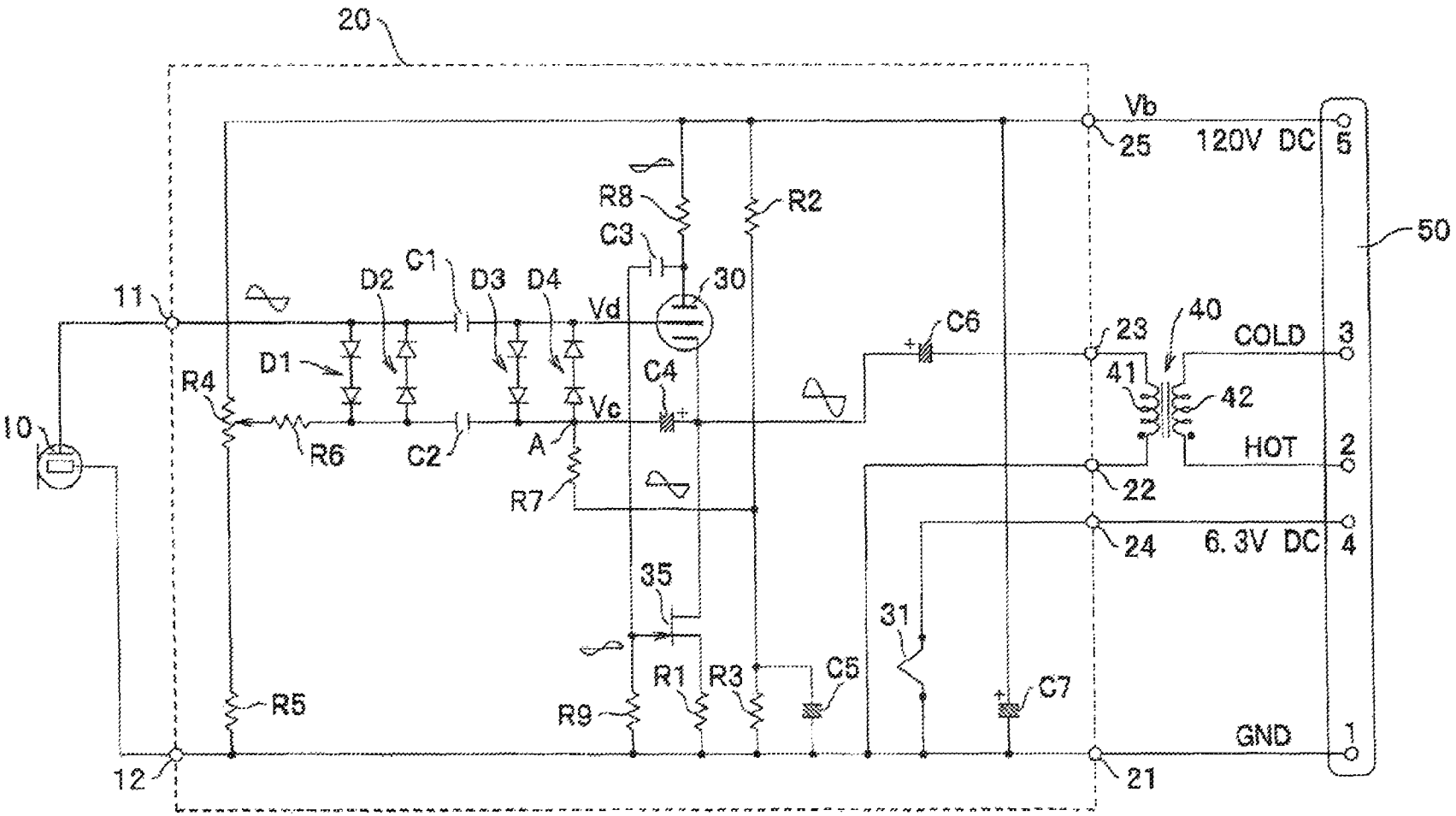
FIG. 1 is a circuit diagram of an embodiment of a capacitor microphone and an impedance converter therefor according to the present invention.
Figure 2:
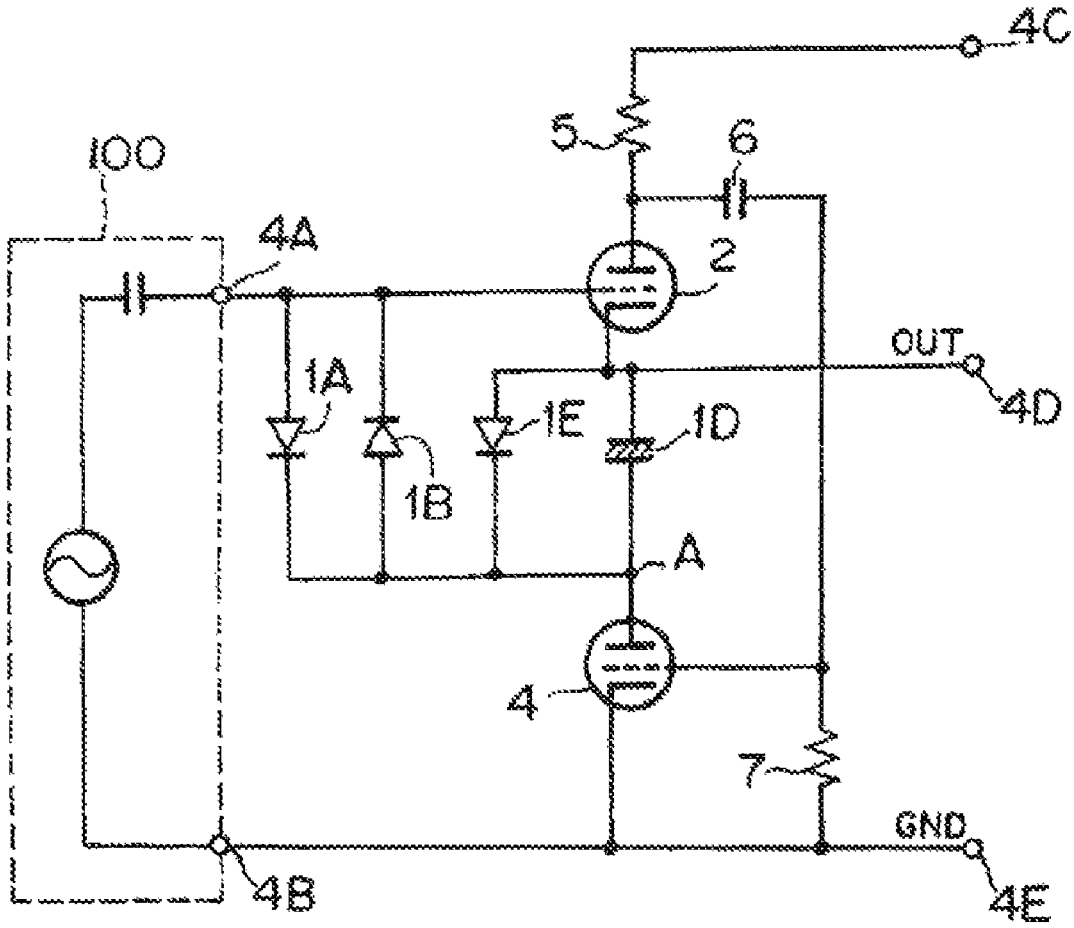
RELATED ART FIG. 2
FIG. 2 is a circuit diagram exemplary depicting a conventional capacitor microphone and an impedance converter therefor.

FIG. 1 shows a capacitor microphone unit 10, and this impedance converter 20 formed in a block defined with the dotted line. Two electrodes forming the capacitor microphone unit 10 are connected to an input terminal 11 and a ground input terminal 12 of the impedance converter 20, respectively. An output signal from the capacitor microphone unit 10 received by the impedance converter 20 through the input terminal 11 is fed to the grid of a vacuum tube 30 via a coupling capacitor C1. The vacuum tube 30 is a triode and serves as an impedance conversion element. A high direct power-supply voltage (for example 120 V) Vb is applied via a supply terminal 25 of the impedance converter 20 to the plate of the vacuum tube 30 via a resistor R8.

The vacuum tube 30 is connected for cathode follower output and is in cascade connection with an FET 35. More specifically, the cathode of the vacuum tube 30 is connected to the drain of the FET 35, while the source of the FET 35 is connected to the ground via a resistor R1 for controlling the plate current of the vacuum tube 30. A capacitor C3 is connected between the plate of the vacuum tube 30 and the base of the FET 35, while a resistor R9 is connected between the base of the FET 35 and the ground. An impedance converted output signal from the cathode of the vacuum tube 30 is output from an output terminal 23 of the impedance converter 20 via an electrolytic capacitor C6.

A bias circuit described below applies a bias voltage to the grid of the vacuum tube 30. Voltage dividing resistors R2 and R3 connected in series between the high power-supply voltage Vb and the ground divide a voltage Vb. The voltage dividing point is connected to the grid of the vacuum tube 30 via a bias resistor R7, a diode D3, and a diode D4. Both of the diodes D3 and D4 are formed of two diodes connected in series. The diodes D3 and D4 are connected in inverse parallel. The cathode of the diode D3 and the anode of the diode D4 are connected to the resistor R7, and the anode of the diode D3 and the cathode of the diode D4 are connected to the grid of the vacuum tube 30. An electrolytic capacitor C4 is connected between a point A which is a connecting point of the resistor R7 and the diodes D3 and D4, and the cathode of the vacuum tube 30. The diode D3 and the diode D4 will be referred to as a first and a second diode, respectively. A voltage divided by the voltage dividing resistors R2 and R3 is applied to the grid of the vacuum tube 30 via the bias resistor R7 and the first diode D3 or the second diode D4. The voltage dividing resistor R3 and a capacitor C5 are connected in parallel.

A variable resistor R4 and a resistor R5 are connected in series between the power-supply voltage Vb and the ground. A variable terminal of the variable resistor R4 is connected to the point A via a resistor R6 and a coupling capacitor C2. Diodes D1 and D2 are connected in inverse parallel between the input terminal 11 and a connection point of the resistor R6 and the capacitor C2. The diodes D1 and D2 are each formed of two diodes connected in series. The anode of the diode D1 and the cathode of the diode D2 are on the input terminal 11 side. The diodes D1 and D2 are connected in a manner similar to that of the diodes D3 and D4 provided across the capacitors C1 and C2. A circuit including the variable resistor R4, resistors R5 and R6, the diodes D1 and D2 applies a direct voltage to the microphone unit 10. The coupling capacitors C1 and C2 prevent the direct voltage from being applied to the grid of the vacuum tube 30.

The impedance converter 20 has, on the output side, another output terminal 22, a heater power supply input terminal 24, and a ground output terminal 21, as well as the above described supply terminal 25 and output terminal 23. In the impedance converter 20, the output terminal 22 and the ground output terminal 21 are connected to the ground, while a heater 31 for the vacuum tube 30 is connected between the heater power supply input terminal 24 and the ground output terminal 21 and a capacitor C7 is connected between the supply terminal 25 and the ground.

A transformer 40 which is provided outside the impedance converter 20 and is contained in, for example, a microphone casing includes a primary winding 41 one of whose ends is connected to the output terminal 22 and the other to the output terminal 23. One of the ends of a secondary winding 42 of the transformer 40 is connected to the hot side terminal of a microphone connector 50 and the other end is connected to the cold side terminal of the microphone connector 50. The ground output terminal 21 of the impedance converter 20 is connected to a ground terminal of the microphone connector 50. The capacitor microphone outputs a balanced signal with the hot side, the cold side, and the ground terminals of the microphone connector 50. The supply terminal 25 and the heater power supply input terminal 24 are connected to corresponding terminals of the microphone connector 50. A connector of a microphone cord is coupled to the microphone connector 50. High-voltage power and power for the heater are supplied to the capacitor microphone through the microphone cord, while a sound signal converted in the microphone is output through the microphone cord as a balanced signal.

In the described embodiment, an output signal from the capacitor microphone unit 10 having high output impedance is fed to the grid of the vacuum tube 30 provided in cathode follower connection and having high input impedance. Due to cathode follower output of the vacuum tube 30, the output impedance becomes low.

The diodes D3 and D4 supply a bias voltage to the vacuum tube 30 in the following manner. Below, a bias voltage generated at the connection point A is given the reference numeral Vc, and a corresponding grid voltage of the vacuum tube 30 is given the reference numeral Vd. In the case where the grid voltage Vd has changed to become lower than the bias voltage Vc, due to forward volt-ampere characteristics in the static characteristic of a diode, a current flows in the diode D3, which causes a voltage drop Vf. The grid voltage Vd is lower than the bias voltage Vc for Vf. Thus, the bias voltage Vc becomes small, and the plate current in the vacuum tube 30 increases, resulting in an increase in the bias voltage Vc. This contributes to the compensation of the change in the grid voltage Vd to reduce the current in the diode D3. The operation is repeated until no current flows in the diode D3. As a result, the change in the grid voltage Vd is so compensated that no current flows in the diode D3, therefore, the voltage drop Vf in the diode D3 is zeroed, and the grid voltage Vd becomes equal to the bias voltage Vc.

On the other hand, in the case where the grid voltage Vd becomes higher than the bias voltage Vc, the second diode D4 operates in the same way as the above described first diode D3. Thus, the change in the grid voltage Vd is compensated to make the grid voltage Vd equal to the bias voltage Vc. Thus, the grid voltage and the cathode voltage in the vacuum tube 30 become substantially the same.

Accordingly, the first and the second diodes D3 and D4 operate with almost no potential difference between their terminals with an alternate current and there is no voltage drop therebetween. Thus, substantially the same effect can be obtained as the case where a high resistance resistor is provided instead of the diodes D3 and D4.

In summary, the bias circuit of the vacuum tube 30 includes: the first and the second diodes D3 and D4 connected in inverse parallel; and the bias resistor R7, and serves as a fixed bias circuit applying a constant bias voltage to the grid of the vacuum tube 30.

The grid voltage and the cathode voltage of the vacuum tube 30 are provided by dividing the high power-supply voltage Vb with the voltage dividing resistors R2 and R3. Therefore, the grid voltage and the cathode voltage can be maintained at constant levels, thereby preventing the production of noise attributable to a change in cathode potential.

The plate current can be controlled to stabilize the plate current by adjusting the resistor R1 for controlling the plate current, which is connected between the source of the FET 35 and the ground and defines the plate current of the vacuum tube 30.

A sound signal from the microphone unit 10 passes through the vacuum tube 30 and thus sound quality degradation is prevented. Because, instead of a vacuum tube, an FET which is in cascade connection with the vacuum tube 30 is used as a circuit element that defines a current flowing in the vacuum tube 30, high sound quality can be maintained while power consumption for heating the vacuum tube can be reduced.

While the first and the second diodes D3 and D4 are each formed of two diodes connected in series, the number of diodes forming each of the diodes D3 and D4 is not limited thereto. For example, the diodes D3 and D4 may each be formed of a single or more than two diodes connected in series.

While the embodiment of the present invention illustrated in FIG. 1 employs the voltage applying circuit which applies voltage to the capacitor microphone unit 10 and includes: the resistors R4, R5, and R6; the diodes D1 and D2; and the capacitors C1 and C2, such a voltage applying circuit is not required to configure an electret capacitor microphone.

The capacitor microphone and the impedance converter therefor according to the present invention are advantageously used by users conscious about sound quality thanks to a vacuum tube used as an impedance conversion element.

What is claimed is:

1. An impedance converter for a capacitor microphone, the converter comprising:

a vacuum tube that receives an output signal from a capacitor microphone unit through a grid and with which the signal is output as an output from a cathode follower;

an FET in cascade connection with the vacuum tube and that defines a current flowing in the vacuum tube;

a bias circuit that applies a bias voltage to the grid of the vacuum tube, wherein the bias circuit includes a first diode and a second diode that apply the bias voltage to the grid of the vacuum tube, the first diode and the second diode being connected in inverse parallel, and a bias resistor for applying the bias voltage at a constant level to the grid of the vacuum tube via the first diode or the second diode; and a resistor for controlling a plate current of the vacuum tube connected to the cascade connection of the vacuum tube and the FET.

2. The impedance converter for a capacitor microphone according to claim 1, wherein the bias voltage applied to the grid of the vacuum tube is a voltage of a high voltage direct power supply divided by a dividing resistor.

3. The impedance converter for a capacitor microphone according to claim 1, wherein the vacuum tube is a triode.

4. A capacitor microphone comprising:

a capacitor microphone unit; and an impedance converter having high input impedance and low output impedance and receiving an output signal from the capacitor microphone unit, wherein the impedance converter comprises a vacuum tube that receives an output signal from a capacitor microphone unit through a grid and with which the signal is output as an output from a cathode follower;

an FET in cascade connection with the vacuum tube and that defines a current flowing in the vacuum tube;

a bias circuit that applies a bias voltage to the grid of the vacuum tube, wherein the bias circuit includes a first diode and a second diode that apply the bias voltage to the grid of the vacuum tube, the first diode and the second diode being connected in inverse parallel, and a bias resistor for applying the bias voltage at a constant level to the grid of the vacuum tube via the first diode or the second diode; and a resistor for controlling a plate current of the vacuum tube connected to the cascade connection of the vacuum tube and the FET.

5. The capacitor microphone according to claim 4, further comprising a transformer wherein an output signal from the impedance converter is output via the transformer as a balanced signal.

* * * * *